US009377243B2

(12) United States Patent
Cincotta

(10) Patent No.: US 9,377,243 B2
(45) Date of Patent: Jun. 28, 2016

(54) HIGH PRESSURE STEAM INJECTION HEATER ASSEMBLY

(71) Applicant: PROSONIX LLC, Wauwatosa, WI (US)

(72) Inventor: Bruce A. Cincotta, Milwaukee, WI (US)

(73) Assignee: Prosonix LLC, West Allis, WI (US)

( * ) Notice: Subject to any disclaimer, the term of this patent is extended or adjusted under 35 U.S.C. 154(b) by 336 days.

(21) Appl. No.: 13/864,110

(22) Filed: Apr. 16, 2013

(65) Prior Publication Data

US 2014/0138858 A1 May 22, 2014

Related U.S. Application Data

(60) Provisional application No. 61/624,674, filed on Apr. 16, 2012.

(51) Int. Cl.
*B01F 3/04* (2006.01)
*F28C 3/08* (2006.01)

(52) U.S. Cl.
CPC ..... *F28C 3/08* (2013.01)

(58) Field of Classification Search
CPC ..... F28C 3/06; F28C 3/08
USPC ..... 261/76, DIG. 10
See application file for complete search history.

(56) References Cited

U.S. PATENT DOCUMENTS

| | | | | |
|---|---|---|---|---|
| 2,913,232 | A * | 11/1959 | Silverman | 261/40 |
| 6,082,712 | A * | 7/2000 | Cincotta et al. | 261/76 |
| 6,186,481 | B1 * | 2/2001 | Pirkle | 261/39.1 |
| 6,361,025 | B1 * | 3/2002 | Cincotta et al. | 261/77 |
| 7,025,338 | B2 * | 4/2006 | Cincotta et al. | 261/64.1 |
| 7,152,851 | B2 * | 12/2006 | Cincotta | 261/64.1 |
| 2009/0200688 | A1 * | 8/2009 | Cincotta | 261/76 |
| 2010/0001419 | A1 * | 1/2010 | Schreib et al. | 261/76 |
| 2014/0138860 | A1 * | 5/2014 | Zaiser et al. | 261/146 |

* cited by examiner

*Primary Examiner* — Charles Bushey
(74) *Attorney, Agent, or Firm* — Joseph S. Heino; Patrick M. Bergin

(57) ABSTRACT

The claimed invention teaches direct contact steam injection heater capable of handling steam pressure in excess of 300 psi. Specifically, the invention provides: a fixed upper seal assembly situated between the diffuser base and the diffuser which is designed to prevent the flow of steam around the regulating member into the diffuser.

15 Claims, 3 Drawing Sheets

HIGH PRESSURE STEAM INJECTION HEATER ASSEMBLY

FIELD OF THE INVENTION

The claimed invention relates generally to direct contact steam injection heaters that are used for heating certain types of liquids and slurries. More specifically, it relates to a high pressure diffuser-type steam injection heater assembly.

BACKGROUND OF THE INVENTION

In direct contact steam injection heaters, steam is directly mixed into a flowing fluid (e.g. liquid or slurry) to heat the flowing fluid. Direct contact steam injection heaters are well known in the art and are very effective at transferring heat energy to the flowing fluid. They provide rapid heat transfer with virtually no heat loss to the atmosphere, and also transfer both the latent and the available sensible heat of the steam to the liquid or slurry.

A shortcoming of existing injection heater designs is that they are only operable at relatively low steam pressures. While adequate for most applications, existing diffuser style injection heater designs are unable to handle steam pressure in excess of approximately 300 psi. Generally speaking, power plants and other facilities with boiler operations have steam pressure in the 250-1200 psi range.

Previous designs of diffuser-type steam injection heaters employ elastomeric, or otherwise pliant, seal elements between the regulating member and the diffuser. In such configurations, a lower seal is intended to prevent steam from leaking around the distal end of the regulating member and into the fluid chamber. An upper seal is intended to prevent steam from leaking between the diffuser and the regulating member.

In the experience of this inventor, such seals can quickly wear out as they ride over the diffuser when the regulating member moves. Moreover, such pliant seals, which may be acceptable at lower pressures, are completely unsuitable for use at higher steam pressures. As a result, in prior heaters, it is difficult to prevent the flow of steam into the diffuser when, for example, it is desired to stop the flow of steam into the fluid to be heated. Therefore, what is needed is a new seal configuration to prevent steam from leaking past the upper seal so that steam can only enter the fluid to be heated through the regulating member.

SUMMARY OF THE INVENTION

In view of the foregoing, what is needed is an improved injection heater assembly that is capable of handling higher pressure steam than existing heaters. Specifically, what is needed is a heater capable of handling steam pressure in excess of 300 psi. The claimed invention provides such a configuration. Generally speaking, the invention provides: a fixed upper seal assembly situated between the diffuser base and the diffuser which is designed to prevent the flow of steam into the diffuser.

More specifically, the fixed upper seal assembly comprises an elastic member; a compression gland and a packing seal, the upper seal assembly being fixed between the diffuser base and the diffuser. Even more specifically, the interior of the diffuser base is threaded as is the exterior of the diffuser such that when the diffuser is threaded into the diffuser base, the fixed upper seal is compressed between the diffuser base and the diffuser. That is, the fixed upper seal serves as a face seal to prevent flow into the diffuser and it also prevents flow between the steam regulating member and the diffuser. The foregoing and other features of the high pressure heating assembly of the claimed invention will be apparent from the detailed description that follows.

DETAILED DESCRIPTION OF THE INVENTION

Figure 1:
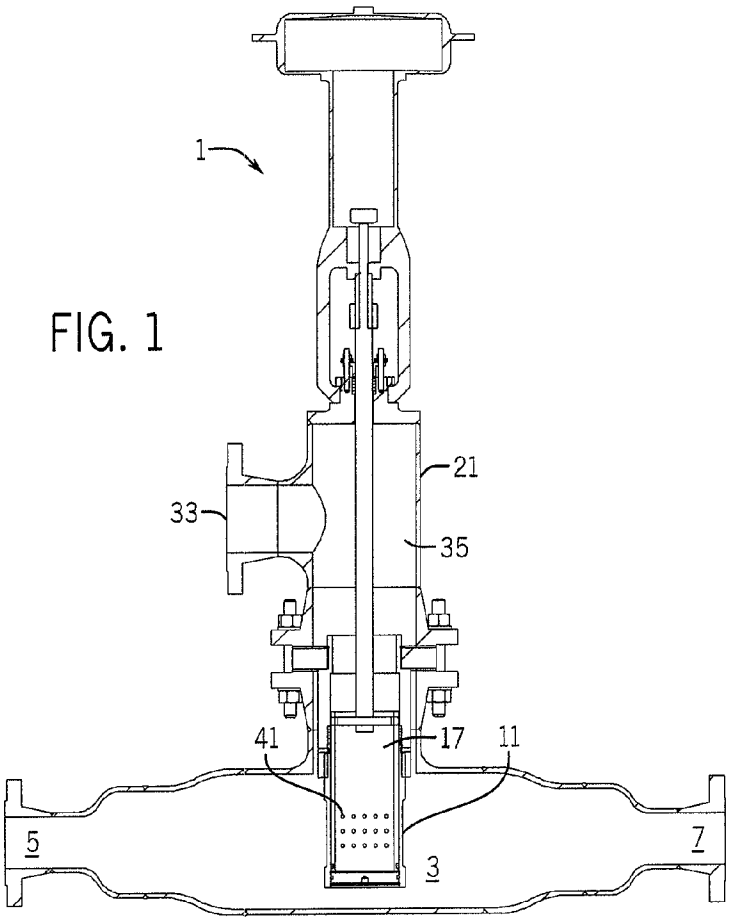
FIG. 1 is a section view of a diffuser style heater assembly that is constructed in accordance with the claimed invention.

Referring now to the drawings in detail, wherein like numbered elements correspond to like elements throughout, FIG. 1 shows a diffuser style heater assembly 1 constructed in accordance with the claimed invention. Generally, the heater assembly 1 comprises a diffuser 11 in a fluid flow chamber 3 having an inlet 5 and an outlet 7.

The heater assembly 1 comprises a diffuser base 21. The diffuser base 21 comprises a steam inlet 33 and a generally open cylindrical interior 35 through which steam is allowed to pass to the regulating member 41. The interior lower portion 23 of the diffuser base 21 further comprises a first narrower portion 22 and a second wider portion 24, the wider portion 24 further comprising a threaded cylindrical aperture 25 and a pair of peripheral threaded apertures 27. The first narrower portion 22 and the second wider portion 24 of the diffuser base are separated by a shoulder 25. The lower portion 23 of the diffuser base 21 further comprises a seal section 29 for accommodating a seal that terminated in a circumferential shoulder 25, the purpose of which will be explained in more detail later in this description.

The diffuser 11 of the claimed invention is generally cylindrical in shape and comprises a plurality of steam diffusion holes 17 such that steam can flow from the diffuser 11 into a fluid flow area such as fluid chamber 3 so as to heat the liquid within the fluid chamber 3. The fluid chamber 3 has an inlet 5 to the fluid chamber 3 for the fluid to be heated and an outlet 7 from the fluid chamber 3 for the heated fluid and steam from the diffuser 11.

Figure 2:
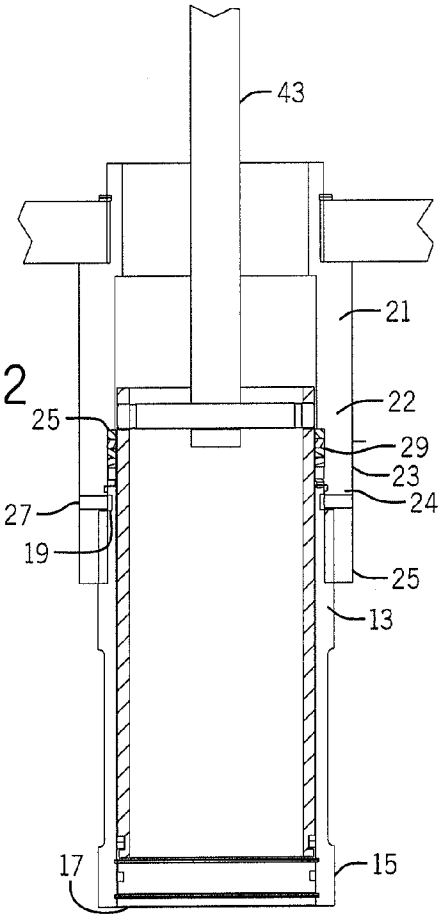
FIG. 2 is a section view of a diffuser showing a more detailed view of the fixed upper seal assembly of the claimed invention.
Figure 4:
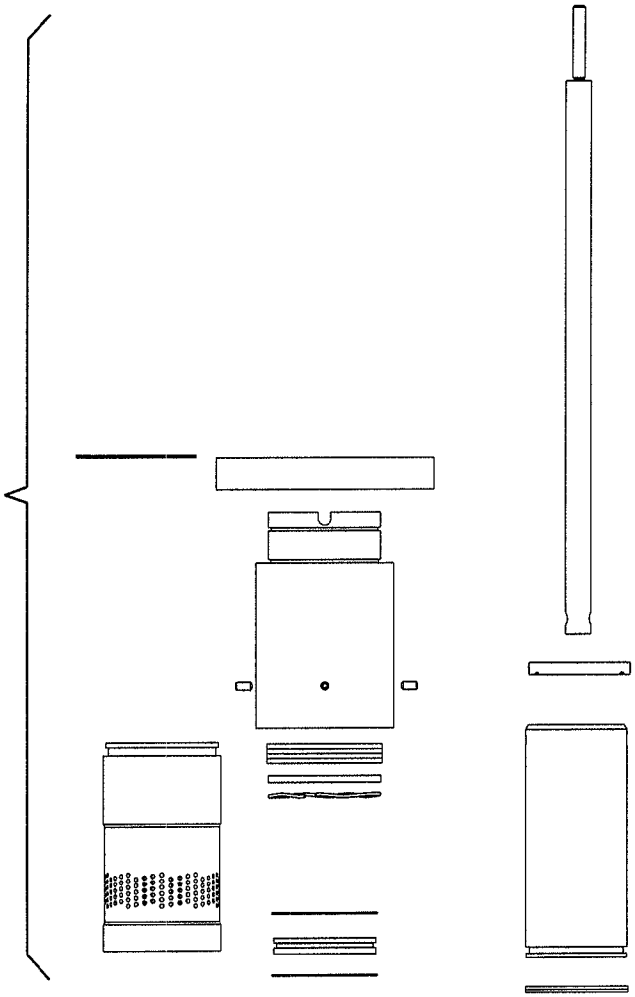
FIG. 4 is an exploded view of a diffuser style heater constructed in accordance with the claimed invention.
Figure 3:
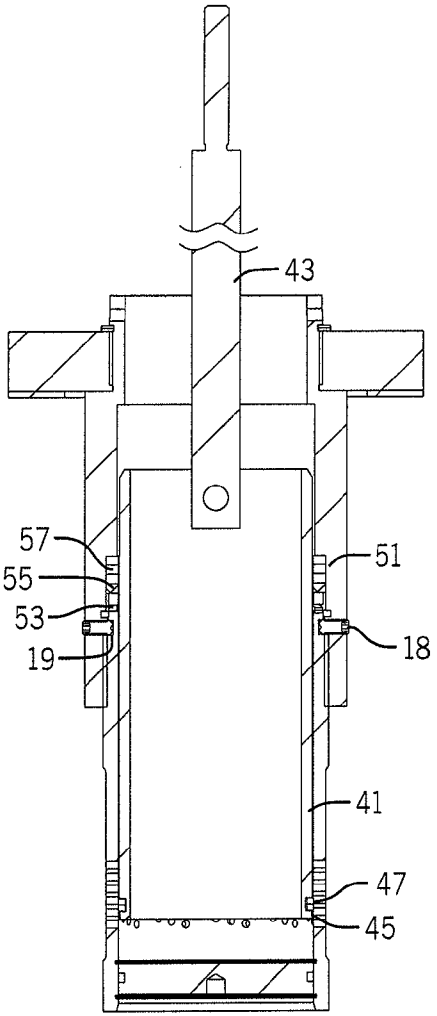
FIG. 3 is a section view of an upper seal assembly constructed in accordance with the claimed invention and showing the securement means.
Figure 5:
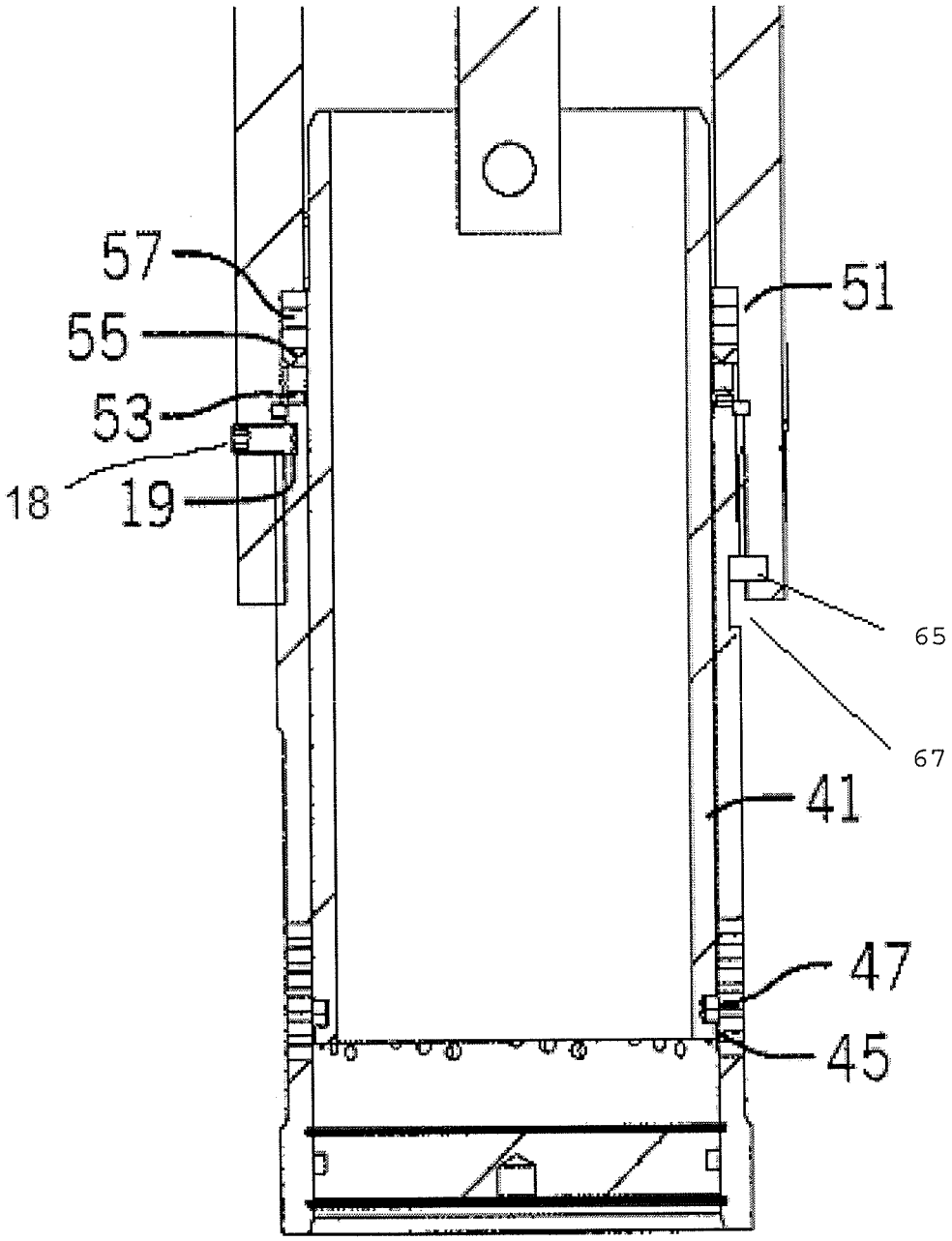
FIG. 5 is a section view of the diffuser showing a more detailed view of a second embodiment of the upper seal assembly.

Referring again to FIG. 2, which shows a more detailed sectional view of the diffuser 11, the diffuser 11 further comprises a proximal end 13 and a distal end 15. The proximal end of the diffuser 13 is threaded so as to thread into the threaded cylindrical aperture 25 of the lower portion of the diffuser base 21 and further comprises a pair of set screw slots 19. Once the diffuser 11 has been securely threaded into the threaded cylindrical aperture 25 of the diffuser base 21, set screws 18 are threaded through the apertures 27 in the diffuser base into the set screw slots 19 to secure the diffuser base 21. Additional means for attaching the diffuser base 21 to the diffuser 11 are also possible. For example, it is possible to press fit the diffuser 11 into the diffuser base 21 and to secure diffuser 11 within the diffuser base 21 using a snap ring 65 within a snap ring pocket 67 as shown in FIG. 5.

The distal end of the diffuser 15 is capped by an end cap 17. Within the diffuser 11, the regulating member 41 is operable by actuation of the modulating stem 43, which is attached to the proximal end of the regulating member 41 to move the regulating member 41 upwardly and downwardly so as to release either more or less steam through the steam diffusion holes 17 in the diffuser 11.

A lower seal 47 is located at the distal end 45 of regulating member 41. The lower seal 45 may be a piston ring type seal so as to provide a better seal to reduce the likelihood that steam will enter the diffuser 11 around the distal end 45 of the regulating member 41 and thus be unintentionally discharged into the fluid chamber 3.

The invention further provides a fixed upper seal assembly 51 within the interior of the diffuser base 21 and situated against the shoulder seal 25. The upper seal assembly 51 is designed to prevent steam from escaping between the regulating member 41 and the diffuser 11. In order to withstand higher steam pressures, the claimed invention provides a multi-layer upper seal assembly 51 situated between the regulating member 41 and the diffuser 11 in the seal section comprising an optional spring member 53, a compression gland 55 and a packing seal 57. As the diffuser 11 is threaded into the diffuser base 21, the fixed upper seal assembly 51 is compressed between the regulating member, the diffuser 11, and the seal section 29 of the diffuser base 21 so as to prevent steam leakage past the upper seal assembly 51.

When the diffuser 11 is threaded into the threaded cylindrical aperture 25 of the diffuser base, the upward motion of the diffuser 11 applies a load to the spring member 53 which in turn compresses the compression gland 55 and packing seal 57. This fixed upper seal assembly 51 allows much higher steam pressures without steam leakage between the regulating member 41 and the diffuser base 21, between the regulating member 41 and the diffuser 11 and between the diffuser 11 and the diffuser base 21. All of this is accomplished while still permitting vertical movement of the regulating member 41 so as to modulate the flow of steam into the diffuser 11.

Additional advantages and modifications will readily occur to those skilled in the art. Therefore, the invention in its broader aspects is not limited to the specific details disclosed and described herein.

What is claimed is:

1. A direct contact steam injection heater assembly comprising:

a generally cylindrical diffuser base comprising a steam inlet; a threaded lower portion and a generally cylindrical sealing area above the lower portion;

a generally cylindrical diffuser comprising a plurality of diffuser holes and a threaded upper portion, the threaded upper portion comprising threads complimentary to the threaded lower portion of the diffuser base and the upper portion of the diffuser being securable to the threaded lower portion of the diffuser base;

a generally cylindrical regulating member movably positionable within the diffuser comprising an outer cylindrical surface; and a sealing member situated in the sealing area above the upper portion of the diffuser in the sealing area between the outer cylindrical surface of the regulating member and the sealing area of the diffuser base, the sealing member being compressible between the upper portion of the diffuser and the lower portion of the diffuser base when the diffuser is secured to the lower portion of the diffuser base.

2. A direct contact steam injection heater assembly comprising:

a generally cylindrical diffuser base comprising a steam inlet; a lower portion and a generally cylindrical sealing area above the lower portion;

a generally cylindrical diffuser comprising a plurality of diffuser holes and upper portion, the upper portion of the diffuser being press fit into the lower portion of the diffuser base;

a generally cylindrical regulating member movably positionable within the diffuser comprising an outer cylindrical surface; and a sealing member situated in the sealing area above the upper portion of the diffuser in the sealing area between the outer cylindrical surface of the regulating member and the sealing area of the diffuser base, the sealing member being compressible between the upper portion of the diffuser and the lower portion of the diffuser base when the diffuser is secured to the lower portion of the diffuser base.

3. A direct contact steam injection heater assembly comprising:

a generally cylindrical diffuser base comprising a steam inlet a lower portion and a generally cylindrical sealing area above the lower portion;

a generally cylindrical diffuser comprising a plurality of diffuser holes and upper portion, the upper portion of the diffuser being secured to the lower portion of the diffuser base using snap rings;

a generally cylindrical regulating member movably positionable within the diffuser comprising an outer cylindrical surface; and a sealing member situated in the sealing area above the upper portion of the diffuser in the sealing area between the outer cylindrical surface of the regulating member and the sealing area of the diffuser base, the sealing member being compressible between the upper portion of the diffuser and the lower portion of the diffuser base when the diffuser is secured to the lower portion of the diffuser base.

4. The injection heater of claim 1 wherein the sealing member further comprises a packing load spring.

5. The injection heater of claim 1 wherein the sealing member comprises a compression gland.

6. The injection heater of claim 1 further comprising a set screw and wherein the diffuser base further comprises at least one set screw aperture and the diffuser comprises at least one set screw slot, the set screw being operable to affix the diffuser to the diffuser base.

7. The injection heater of claim 1 wherein the sealing member is compressed longitudinally by threading the diffuser into the diffuser base.

8. A direct contact steam injection heater assembly comprising:

a generally cylindrical diffuser base comprising a steam inlet, a generally cylindrical interior portion and an interior lower portion comprising a first narrower portion and a second wider portion comprising a sealing area and an internally threaded lower portion, a shoulder defining the separation between the first narrower portion and the second wider portion;

a generally cylindrical diffuser concentric with the diffuser base; the diffuser comprising a plurality of diffuser holes and a threaded upper portion, the threaded upper portion being securable to the threaded lower portion of the diffuser base;

a generally cylindrical regulating member concentric with the diffuser base and the diffuser, the regulating member being movably positionable within the diffuser and comprising an outer cylindrical surface; and a sealing member situated in the sealing area above the threaded upper portion of the diffuser and between the outer cylindrical surface of the regulating member and the sealing area of the diffuser base, the sealing member being longitudinally compressed by threading the diffuser onto the diffuser base and concentrically compressed between the sealing area of the diffuser base and the regulating member.

9. The injection heater of claim 8 wherein the sealing member further comprises a packing load spring.

10. The injection heater of claim 8 wherein the sealing member comprises a compression gland.

11. The injection heater of claim 8 further comprising a set screw and wherein the diffuser base further comprises at least one set screw aperture and the diffuser comprises at least one set screw slot, the set screw being operable to affix the diffuser to the diffuser base.

12. A direct contact steam injection heater assembly comprising:

a generally cylindrical diffuser base comprising a steam inlet and a generally cylindrical lower interior portion comprising a first narrower portion, a second wider portion and a shoulder defining the separation between the first narrower portion and the second wider portion, the wider portion further comprising a sealing area and an internally threaded lower portion;

a generally cylindrical diffuser concentric with the diffuser base; the diffuser comprising a plurality of diffuser holes and a threaded upper end, the threaded upper end being removably securable to the threaded lower portion of the diffuser base;

a generally cylindrical regulating member, the regulating member being located concentrically within the diffuser base and the diffuser, the regulating member movably positionable within the diffuser and comprising an outer cylindrical surface; and a sealing member situated in the sealing area above the threaded upper portion of the diffuser in the sealing area between the outer cylindrical surface of the regulating member and the outer surface of the sealing area, the sealing member being longitudinally compressed by threading the diffuser onto the diffuser base to compress the sealing member against the shoulder of the diffuser base and concentrically compressed between the sealing area of the diffuser base and the regulating member.

13. The injection heater of claim 12 wherein the sealing member further comprises a packing load spring.

14. The injection heater of claim 12 wherein the sealing member comprises a compression gland.

15. The injection heater of claim 12 further comprising a set screw and wherein the diffuser base further comprises at least one set screw aperture and the diffuser comprises at least one set screw slot, the set screw being operable to affix the diffuser to the diffuser base.

* * * * *